United States Patent [19]

Tate

[11] Patent Number: 4,529,110

[45] Date of Patent: Jul. 16, 1985

[54] ATTACHMENT TO IMPROVE WIRE OR OTHER COATHANGERS

[75] Inventor: William G. Tate, Narrabundah, Australia

[73] Assignee: Arlco PTY Limited, Mascot, Australia

[21] Appl. No.: 460,442

[22] Filed: Jan. 24, 1983

[30] Foreign Application Priority Data

Jan. 28, 1982 [AU] Australia ..... PF2455

[51] Int. Cl.[3] ..... A47J 51/094; A47J 51/142

[52] U.S. Cl. ..... 223/85; 223/88; 223/92; 223/95; D6/328

[58] Field of Search ..... 223/85, 86, 87, 88, 223/92, 95; D6/257, 328

[56] References Cited

U.S. PATENT DOCUMENTS

| | | | |
|---|---|---|---|
| 1,367,062 | 2/1921 | Lichter | 223/87 |
| 1,740,566 | 12/1929 | Batts | 223/88 |
| 2,386,059 | 10/1945 | Potoczky | 223/88 |
| 2,398,873 | 4/1946 | Ward | 223/86 |
| 2,562,566 | 7/1951 | Meyerhoff | 223/92 |
| 3,059,824 | 10/1962 | Henry | 223/98 X |
| 3,241,733 | 3/1966 | Tillery | 223/87 |
| 3,257,049 | 6/1966 | Smith | 223/88 |
| 3,445,045 | 5/1969 | Panning | 223/95 |
| 3,484,029 | 12/1969 | Gaydos | 223/85 |

*Primary Examiner*—Robert R. Mackey
*Attorney, Agent, or Firm*—Ladas & Parry

[57] ABSTRACT

An accessory for secure attachment upon a wire coathanger to provide an enlarged area for support of a shoulder of a garment, and comprising a two-part hollow molded body having an enlarged support surface for the garment, a slot in one side for the entry of the wire at a lower corner of the coathanger, and a post formed in two parts integrally with respective halves of the molded body and having a gap narrower than the wire diameter and defined by confronting oppositely inclined chamfers through which the wire is forcibly entered for positioning of the accessory upon the coathanger.

3 Claims, 5 Drawing Figures

ATTACHMENT TO IMPROVE WIRE OR OTHER COATHANGERS

This invention relates to coathangers, and more particularly to an accessory for conventional wire coathangers.

A very popular, and simple, form of coathanger is the so-called wire coathanger which is composed simply of a strip of wire bent into the general shape of a triangle with its ends twisted together at the apex and one end extending therefrom and bent into a hook. Although many hotels, and almost all drycleaning establishments, utilise these devices, storage of a jacket or coat or knitwear on same for any appreciable length of time results in deformation of the shoulder line on the garment due to the small area of support provided. Frequently, such coathangers are discarded by the public due to this defect and a good deal of wastage occurs.

It is the principal object of the invention to provide an accessory for use with said coathangers which sufficiently improves the support provided for a shoulder of a garment substantially to avoid any shoulder deformation.

According to one general form of the invention, there is provided an accessory for a wire coathanger of the kind composed of a wire bent into a triangular-shaped body which has two lower corners and an apex, or top corner, provided with a supporting hook, said accessory comprising a hollow body of thermoplastic material having at least one aperture in one side and adapted to be supported over one of said lower corners with said wire passing through said aperture or apertures, and an enlarged support surface on the top of said body to support thereon without substantial deformation a respective shoulder of a hung garment.

The invention will be described in more detail with reference to the accompanying drawings, in which.

Figure 1:
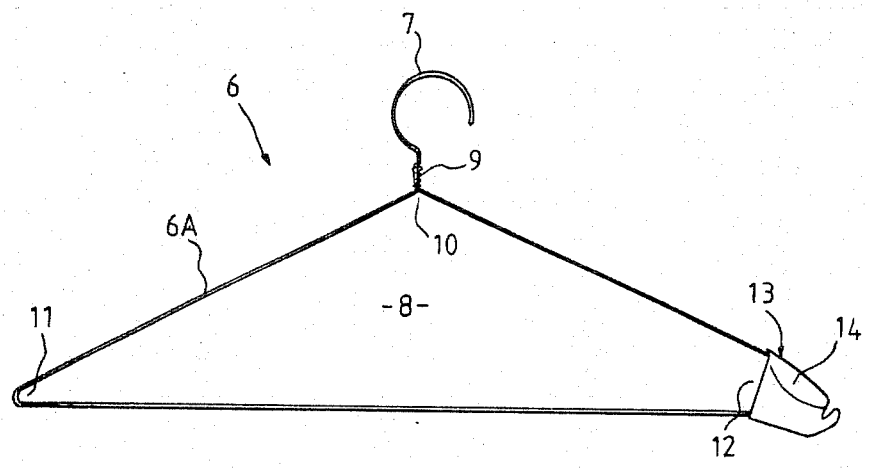
FIG. 1 shows in elevation a conventional wire coathanger on one lower corner of which is mounted an accessory of this invention.

With reference to FIG. 1, it will be noted that a conventional wire coathanger 6 is composed solely of a length of wire 6A curled at one end into the shape of a supporting hook 7 and then bent at three spaced positions to form a triangle 8 with the outer end 9 of the wire 6A twisted about the wire at the base of the hook 7 to form an apex, or upper corner, 10. Lower corners 11 and 12 are also provided on the triangular body 8. An accessory 13 constructed in accordance with this invention is shown secured to the lower corner 12 of the body 8. An enlarged head 14 is formed on the accessory 13 and will provide a substantially larger area of support for the shoulder of a garment hung upon the coathanger 6 thereby avoiding deformation of the shoulder area of the garment.

Figure 2:
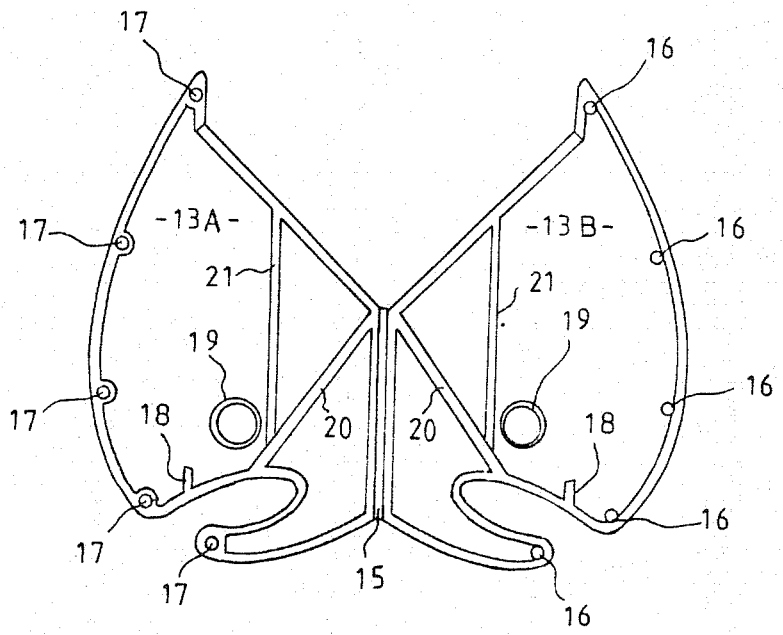
FIG. 2 is a plan view of a moulding of the accessory.
Figure 5:
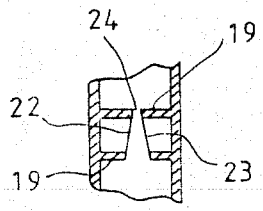
FIG. 5 is a fragmentary detail in section as viewed on the section line B—B of FIG. 4.

The accessory 13 is composed of a thermoplastic moulding which is preferably, as shown in FIG. 2, formed of two halves 13A and 13B interconnected by a web 15 functioning as a hinge to facilitate assembly. The two halves 13A and 13B may be of identical form except that connecting dowels 16 are provided on one half 13B while half 13A has recesses 17 to register with the dowels 16 for assembly. For a purpose to be described hereafter, an abutment rib 18 and connection post 19 are formed in two corresponding halves in the opposite halves 13A and 13B of the accessory 13. Reinforcing ribs 20 and 21 are similarly formed. Whereas the two halves of the ribs 18 and 20 abut when the accessory moulding is closed, the two halves of the post 19 and the rib 21 remain spaced from each other. As can be more clearly seen in FIG. 5, the two halves of the post 19 at their inner ends are provided with opposite chamfers 22 and 23 which at their converging ends provide a narrow gap 24.

Figure 3:
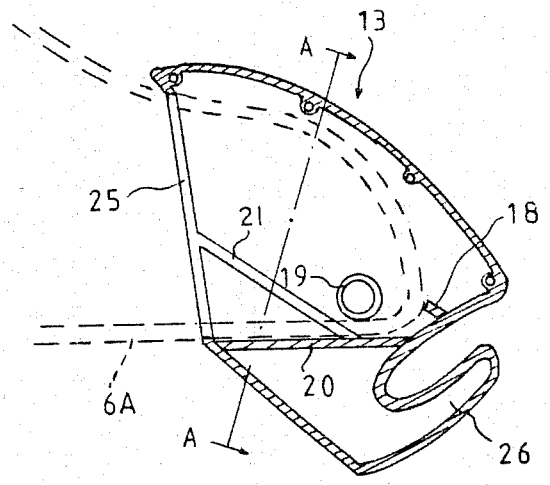
FIG. 3 shows in side elevation the accessory of FIG. 2 when the moulding thereof is closed.
Figure 4:
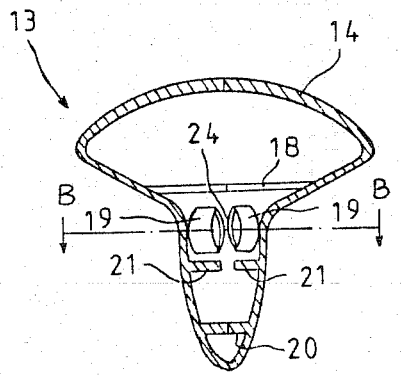
FIG. 4 is a sectional view thereof as viewed on the section line A—A of FIG. 3.

FIG. 3 shows the lower corner 12 of the coathanger 6 with its wire 6A locked in position within the hollow body of the accessory 13. The wire 6A is introduced by forcing the lower corner 12 of the coathanger 6 through the slot 25 in one side of the accessory and through the slot 24 which is of a lesser dimension than the diameter of the wire 6A. Thus, due to resiliency in the moulding material, the accessory 13 is then locked upon the hanger 6 over its lower corner 12 due to the wire 6A being incapable of withdrawal through the slot 24 and being clamped tightly between the ribs 18 and 20 and the post 19 as well as the upper end of the slot 25.

A preferred embodiment has been described in the above passages but it should be understood that modifications and refinements thereto are possible within the scope of the invention. As one refinement, a projecting tongue 26 may be provided in the underside of the accessory near its outer end for the purpose of supporting skirts, trousers or other wearing apparel.

What I claim is:

1. An accessory for a wire coathanger of the kind composed of wire bent into an upright triangular-shaped body which has two lower corners and an apex provided with a supporting hook, said accessory comprising a hollow body of moulded thermoplastic material formed in two mating halves, said halves including reinforcing ribs which are spaced from one another when said halves are joined, forming an aperture in one side and being supported over one of said lower corners when said wire is forced into said aperture, locking means comprising a post formed in two parts within respective halves of the moulded body having a gap defined by confronting oppositely inclined chamfers, said gap being narrower than the diameter of said wire to permit forcible entry of the wire at said one corner while restraining withdrawal of said wire, said mating halves being provided with ribs which abut when said halves are joined so as to assure locking of the accessory, and an enlarged support surface on the top of said body to support thereon without substantial deformation a respective shoulder of a hung garment.

2. An accessory according to claim 1, wherein said two mating halves are moulded hinged together by a connecting web.

3. An accessory according to claim 2, wherein said aperture is a slot formed when said halves are locked together.

* * * * *